US006032745A

United States Patent [19]

Sears

[11] Patent Number: 6,032,745

[45] Date of Patent: Mar. 7, 2000

[54] VALVE FOR FIRE SUPPRESSION DEVICE

[75] Inventor: Richard F. Sears, Kenly, N.C.

[73] Assignee: Kidde Technologies, Inc., Wilson, N.C.

[21] Appl. No.: 09/120,238

[22] Filed: Jul. 23, 1998

[51] Int. Cl.[7] ..... A62C 35/02

[52] U.S. Cl. ..... 169/29; 251/68

[58] Field of Search ..... 169/26, 29, 19, 169/30, 74–76; 251/68, 74, 66

[56] References Cited

U.S. PATENT DOCUMENTS

| | | | |
|---|---|---|---|
| 4,476,937 | 10/1984 | Roznieck i | 169/26 |
| 4,579,315 | 4/1986 | Kowalski | 251/67 |
| 4,589,496 | 5/1986 | Roznieck i | 251/74 X |
| 4,691,736 | 9/1987 | Kowalski | 137/557 |

*Primary Examiner*—Lesley D. Morris
*Attorney, Agent, or Firm*—Leydig, Voit & Mayer Ltd.

[57] ABSTRACT

A fire suppression valve for use with a cannister of fire suppression material. The valve has a housing with a central connection for attachment to the cannister and communicating with a central chamber. The central chamber has a relatively smaller outlet port on one side and diametrically opposite thereto a concentric and relatively larger piston port. A two-stage piston operates inside the central chamber to control access to the outlet port. In the closed position, the pressure of the fire suppression material serves to bias the two-stage piston toward the open position. The two-stage piston is oriented along an axis that is angled with respect to the orientation of the central connection, to thereby minimize the amount of vertical space required by the valve maximize cannister size for a given space limitation. The outlet port and piston port are preferably formed by a gun reaming process which produces highly finished and concentric sealing surfaces which more reliably engage the piston end and actuating piston. The actuating piston is adapted for use with dry powder suppression material by carrying a piston gasket having a scraper member for clearing the piston port to allow a sealing member to reliably seal with the piston port. The piston end is removable to allow for thorough cleaning and replacement of an outlet gasket. In an alternative embodiment, the piston end carries a specially formed gasket which incorporates a scraper portion for use with dry powder material which may be permanently bonded to the piston end.

15 Claims, 4 Drawing Sheets

VALVE FOR FIRE SUPPRESSION DEVICE

FIELD OF THE INVENTION

The present invention generally relates to valves, and more particularly relates to valves for controlling discharge of fire suppression material.

BACKGROUND OF THE INVENTION

A typical fire suppression device comprises a cannister of pressurized fire suppression material and a valve. The fire suppression material in the cannister may include a propellant, if necessary, to discharge the fire suppression material. The valve has an outlet port through which suppression material from the cannister is discharged. The valve typically has a valve member or piston which moves inside a central chamber between a closed position, in which the suppression material is prevented from reaching the outlet port, and a closed position, in which the suppression material is released. The piston is normally latched in the closed position to resist a pressure force from the pressurized suppression material. The latch may be selectively released, allowing the pressure on the piston to displace it, opening the discharge port which it had blocked.

Fire suppression devices are often used in limited space environments. The interior of the Bradley fighting vehicle, for example, is relatively compact and has a designated amount of space dedicated for storing fire suppression devices. It is, however, desirable for the device to store as much fire suppression material as possible in the given space. This is particularly so in the military application where advanced sensors can trigger highly responsive extinguishers to provide important life-saving functionality.

Conventional fire suppression devices do not maximize the amount of suppression material contained in a given space. In order to meet space limitations, it will be appreciated that the size of the cannister is reduced by the profile height of the valve. Previous devices have pistons which actuate in a vertical direction, aligned with the cannister. As a result, considerable vertical space is taken up by the valve, thereby reducing cannister height and, consequently, volume of suppression material available.

Furthermore, fire suppression valves typically use a pressure force created by the pressurized suppression material to actuate the piston from the closed to the open position. More specifically, previous fire suppression devices often releasably lock the piston in the closed position so that a piston end of the piston blocks an outlet passage to prevent discharge of suppression material. A trigger mechanism is then used to release the lock, thereby allowing the pressure force of the pressurized suppression material to actuate the valve mechanism to an open position. Therefore, in conventional, vertically oriented valves, the piston end not only prevents flow of suppression material in the closed position, but also provides an actuating surface against which the pressure force acts to move the piston to the open position.

Certain conventional fire suppression valves also fail to adequately seal the valve against leakage of low molecular weight propellant. In the closed position, the valve member must seal with the outlet passage to reliably prevent propellant from escaping over extended periods of time. It will be appreciated, however, that materials having lower molecular weights are capable of escaping through relatively small gaps in the valve. As a result, when a valve is used with a sole propellant such as nitrogen gas, which has a relatively low molecular weight of 28 when compared to other fire suppression materials like Halon 1301, having a molecular weight of 148.9, the piston must form a tight seal with the outlet port. Unfortunately, some conventional valves are not reliably formed with adequate seal compression.

It is also desirable to reuse components of the fire suppression device after the suppression material is discharged. Reuse of the valve, without the need for replacing expensive components, can be particularly significant in military applications, where the devices are discharged fairly frequently. It is more difficult, however, to reuse a valve through which dry powder has been discharged. In such applications, the interior of the valve is covered with dry powder particles. The particles are known to disrupt the internal seals of the valve, thereby facilitating leakage of suppression material. While attempts may be made to clean the inside of the valves, such as with pressurized air, it is not certain that all powder particles will be removed. Furthermore, more thorough cleaning often requires a significant amount of valve disassembly.

SUMMARY OF THE INVENTION

A general aim of the present invention is to provide a fire suppression valve having a low profile, thereby maximizing the size of a cannister attached to the valve for a given space limitation.

In that regard, it is an object of the present invention to provide a valve which utilizes minimal vertical space by dispensing with the conventional alignment of valve piston and cylinder axes.

Another object of the present invention is to provide a valve having improved internal seals to minimize propellant leakage.

Yet another object of the present invention is to provide a valve which can be used repeatedly with dry powder suppression material.

In that regard, a more detailed object of the present invention is to provide a valve which minimizes the amount of powder reaching the internal seals of the valve.

Further in that regard, it is an object of the present invention to provide a valve which may be thoroughly cleaned with minimal disassembly.

Still another object of the present invention is to provide a method for forming a valve having an inside bore finished to low tolerances.

In light of the above, it is a feature of the present invention to provide a valve having a central connection for attachment to a cannister oriented along a first (or vertical) axis. The central connection communicates with a central chamber having an outlet port and a piston port at opposite ends. A piston is disposed in the central chamber and is oriented along a second axis. The first axis is disposed at an angle with respect to the second axis to minimize vertical space required for the valve. The vertical space saved not only includes space needed to accommodate the length of the piston but also its associated stroke in the vertical direction. Consequently, the size of the cannister attached to the valve may be increased, thereby maximizing the amount of suppression material available in a fire suppression device designed to fit inside a given space.

Another feature of the present invention is to provide a staged central chamber with matching two-stage piston. The central chamber has a relatively smaller outlet port diametrically opposite a larger piston port. The two-stage piston actuates inside the central chamber and has a piston end and an actuating piston. In the closed position, the piston end is interposed in and blocks the discharge port. The actuating piston is larger than and formed separately from the piston end, and engages the piston port of the central chamber. It will be understood that in the closed position, the piston end and actuating piston prevent suppression material from escaping through the outlet and piston ports, respectively. While substantially the same pressure from the cannister acts on both the piston end and actuating piston, the larger size of the actuating piston creates a greater force acting to bias the piston toward the open position.

Internal seals formed at the outlet and piston ports are adapted for use with a wide variety of suppression materials, including those comprising powder or gas, or having either high or low molecular weight. In more difficult applications, the internal seals have a greater seal compression to retain materials having relatively low molecular weight. In this embodiment, the outlet and piston ports are formed using a gun reamer, which creates surface finishes better than 8$\mu$-in and maintains concentricity of the ports within 0.0001 inches. The precise finishing of the outlet and piston ports is easily repeated with the "gun reamer" and allows for a more reliable fit with the piston. Furthermore, the actuating piston and piston end may be formed from the same material as the valve housing to minimize the effects of thermal expansion on the seal. The valve of the present invention, therefore, has more reliable, higher compression seals for retaining low molecular weight propellants.

According to one embodiment of the present invention adapted particularly for use with dry powder suppression material, the actuating piston carries a piston gasket having a scraping member and a sealing member. The scraping member engages the piston port and clears powder or other debris from the piston port as the piston moves from the open to the closed position, thereby allowing the sealing member to more reliably seal between the piston port and the actuating piston. The piston end is similarly adapted for use with dry powder suppression material. The piston end is removable from the rest of the piston with minimal disassembly of the valve to allow thorough cleaning. The piston end carries an outlet gasket which forms a seal between the piston end and the outlet port in the closed position. When the outlet gasket is a typical o-ring, the removable piston end feature allows the o-ring to be removed and replaced. In the most preferred embodiment, the outlet gasket is specially formed for permanent attachment to the piston end. The specially formed gasket has a complex cross-sectional shape comprising a scraping and sealing portions connected by a web. The scraping portion clears the surface of the outlet port as the piston end is moved from the open to the closed position. As a result, a more reliable seal is formed between the outlet port and piston end. In the most preferred embodiment, the outlet seal does not require replacement, and therefore may be permanently attached to the piston end, thereby eliminating a potential leak path.

These and other objects and advantages of the invention will become more apparent from the following detailed description when taken in conjunction with the accompanying drawings.

Figure 1:
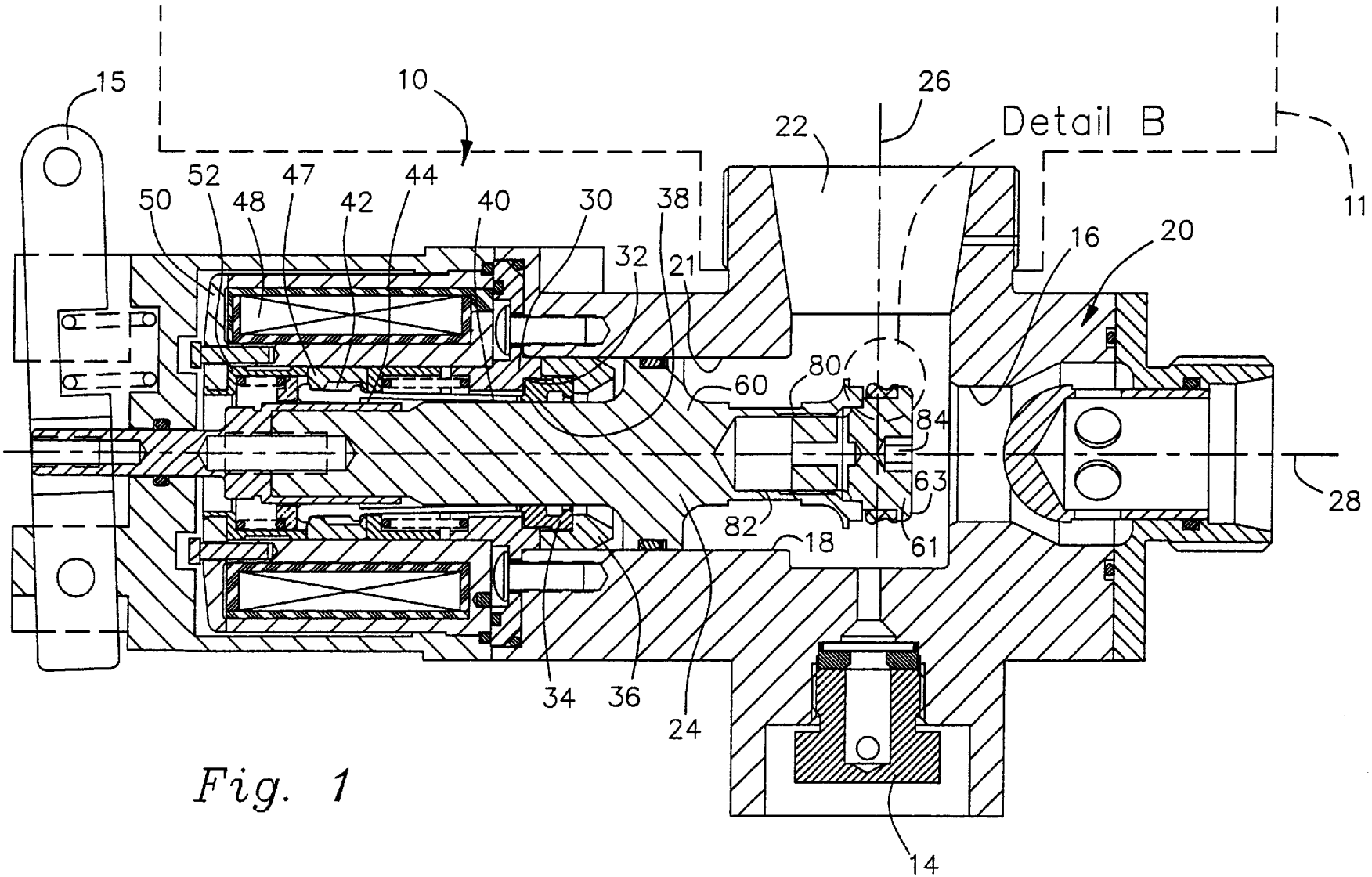
FIG. 1 is a sectional view of a valve in accordance with the present invention showing the piston in the open position, a piston end of the piston having a permanent outlet gasket.

While the invention is susceptible of various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention as defined by the appended claims.

DETAILED DESCRIPTION OF THE PREFERRED EMBODIMENT

Figure 2:
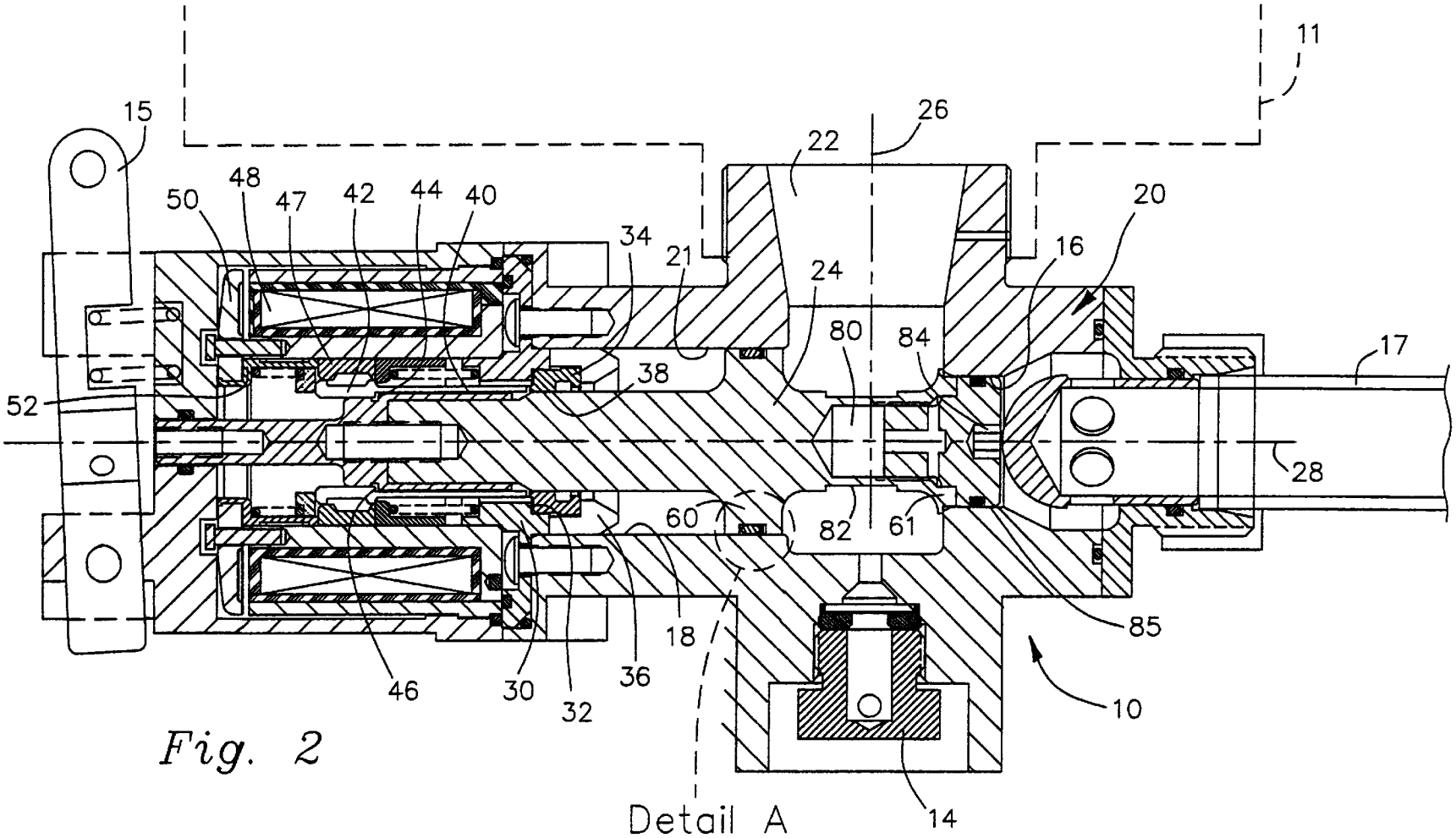
FIG. 2 is a sectional view similar to FIG. 1 showing the piston in the closed position, the piston end having a replaceable outlet gasket.

Referring now to the drawings, and specifically FIGS. 1 and 2, a fire suppression valve 10 is shown for attachment to a cannister 11, illustrated in broken lines. The cannister 11 holds fire suppression material. As used herein, fire suppression material encompasses a wide variety of materials used to extinguish fires. For example, the material may take the form of a dry powder or a vaporizing liquid agent (such as Halon 1301, HFC 227ea, or HFC 236fa). Fire suppression materials also may include propellants, such as nitrogen gas, which help pressurize the suppression material. According to the illustrated embodiment, the valve 10 includes a thermal pressure relief assembly 14 and a solenoid-actuated trigger mechanism for discharging the contents of the cannister 11 through an outlet port 16. Manual means 15 are also provided for triggering the valve. An outlet hose 17 is attached to the valve outlet for directing the suppression material toward the desired area.

Referring to the valve 10 in greater detail, it will be seen that the valve comprises a valve housing 20 having a low vertical profile for maximizing cannister size for a given envelope of space. The valve housing 20 has a central connection 22 for attachment to the cannister 11. The central connection 22 communicates with a central chamber 21 comprising the outlet port 16 and a piston port 18. From FIGS. 1 and 2 it will be appreciated that the central connection 22 is aligned along a first axis 26 which is illustrated as running in a vertical direction. When used herein, vertical and horizontal denote relative position and not necessarily the required orientation of the cannister 11. The central chamber 21 of the housing 20 contains a two-stage piston or poppet 24 oriented along a second axis 28, shown in FIGS. 1 and 2 as extending horizontally. The piston 24 is supported for movement along the second axis 28 between open and closed positions as described in greater detail below.

The valve housing 20 has a trigger mechanism for releasably latching the piston 24 in the closed position. As best shown in FIGS. 1 and 2, a retaining plate 30 is fastened to the valve housing 20 having a locating shoulder 32 sized to receive a collect 34. The retaining plate 30 also supports an annular buffer 36 formed of elastomeric material. The collet 34 has an inner bore 38 which provides radial piloting support for the body of the piston 24. The collect 34 also has a plurality of elongated collet fingers 40. Each collect finger 40 has an enlarged lower end 42 which will be understood to be radially displaceable as a result of compliant flexibility along the length of each finger. The lower end 42 of each collet finger 40 has an inner shoulder 44 projecting radially inwardly toward the second axis 28. The piston 24 has an abutment 46 shaped to complement the inner shoulders 44. Accordingly, when engaged, the inner shoulders 44 act against the abutment 46 to hold the piston in the closed position. An outer sleeve 47 is positioned to confine the lower ends 42 of the collect fingers 40 to thereby resist the pressure force of the suppression material which urges the piston 24 toward the open position.

The trigger mechanism may be actuated to unlock the piston and allow it to move toward the open position. As illustrated in FIGS. 1 and 2, a solenoid 48 which controls the location of an armature plate 50. The armature plate 50 is axially supported by an armature stem 52 attached thereto. The armature stem 52 engages the outer sleeve 47 so that the position of the armature plate 50 influences the position of the outer sleeve. In the normal, closed position, the armature plate 50 is spaced from the solenoid 48 so that the outer sleeve 47 confines the lower ends 42 of the collect fingers 40, as shown in FIG. 2. When the solenoid 48 is energized, the armature plate 50 is pulled toward the solenoid, thereby pushing the outer sleeve 47 via the armature stem 52. In this position, the outer sleeve 47 no longer confines the lower ends 42 of the collect fingers 40. The flexibility of the elongate collect fingers 40 allows the lower ends 42 to shift radially outwardly under the pressure force exerted on the piston, thereby allowing the abutment 46 of the piston to slide past the inner shoulder 44 of the collect fingers 40. The piston 24 is then free to move past the collect 34 until the shoulder engages the buffer 36, thereby defining the open position illustrated in FIG. 1. Those skilled in this art will appreciate that this structure provides a quick trigger mechanism which rapidly opens an outlet port of relatively substantial size, for rapid release of fire suppression material. Other trigger mechanisms known in the art may also be used. In addition, as illustrated in FIGS. 1 and 2, the manual means 15 may be used to trigger the valve.

In accordance with certain aspects of the present invention, the first axis 26, along which the central connection 22 and cannister are aligned, is disposed at an angle in relation to the second axis 28, along which the piston 24 is aligned. As best illustrated in FIGS. 1 and 2, the first axis 26 is shown at a 90° angle with respect to the second axis 28. By aligning the piston 24 and related trigger mechanism along the second axis 28, the vertical height of the valve 10 is minimized. As a result, the size of the cannister may be increased to fit inside a given space.

According to additional aspects of the present invention, the two-stage piston 24 has opposed piston surfaces subjected to substantially the same pressure from the cannister 11. The first piston surface (referred to herein as a valve end 61) is interposed in and blocks the outlet port 16 of the central chamber 21. The second piston surface (referred to herein as an actuating piston 60) is formed separately from and larger than the piston end 61, and provides the operating force to translate the piston 24 when triggered. When in the closed position, as illustrated in FIG. 2, it will be appreciated that pressure from the cannister 11 communicates through the central connection 22 to the central chamber 21 to exert pressure force on both the actuating piston 60 and the piston end 61. Because of its larger size, the pressure force is greater on the actuating piston 60 and therefore serves to bias the piston 24 toward the open position. When one of the trigger mechanisms is operated, the pressure force immediately pushes the piston 24 toward the open position.

In the preferred embodiment, the valve 10 also has precisely formed internal seals for retaining low molecular weight materials. As shown in the closed position in FIG. 2, the piston end 61 is interposed in and seals with the outlet port 16, and the actuating piston 60 engages a piston port 18 of the central chamber 21 to form another seal. It will be appreciated that these seals must closely fit to retain the pressurized suppression material of the cannister.

Figure 5:
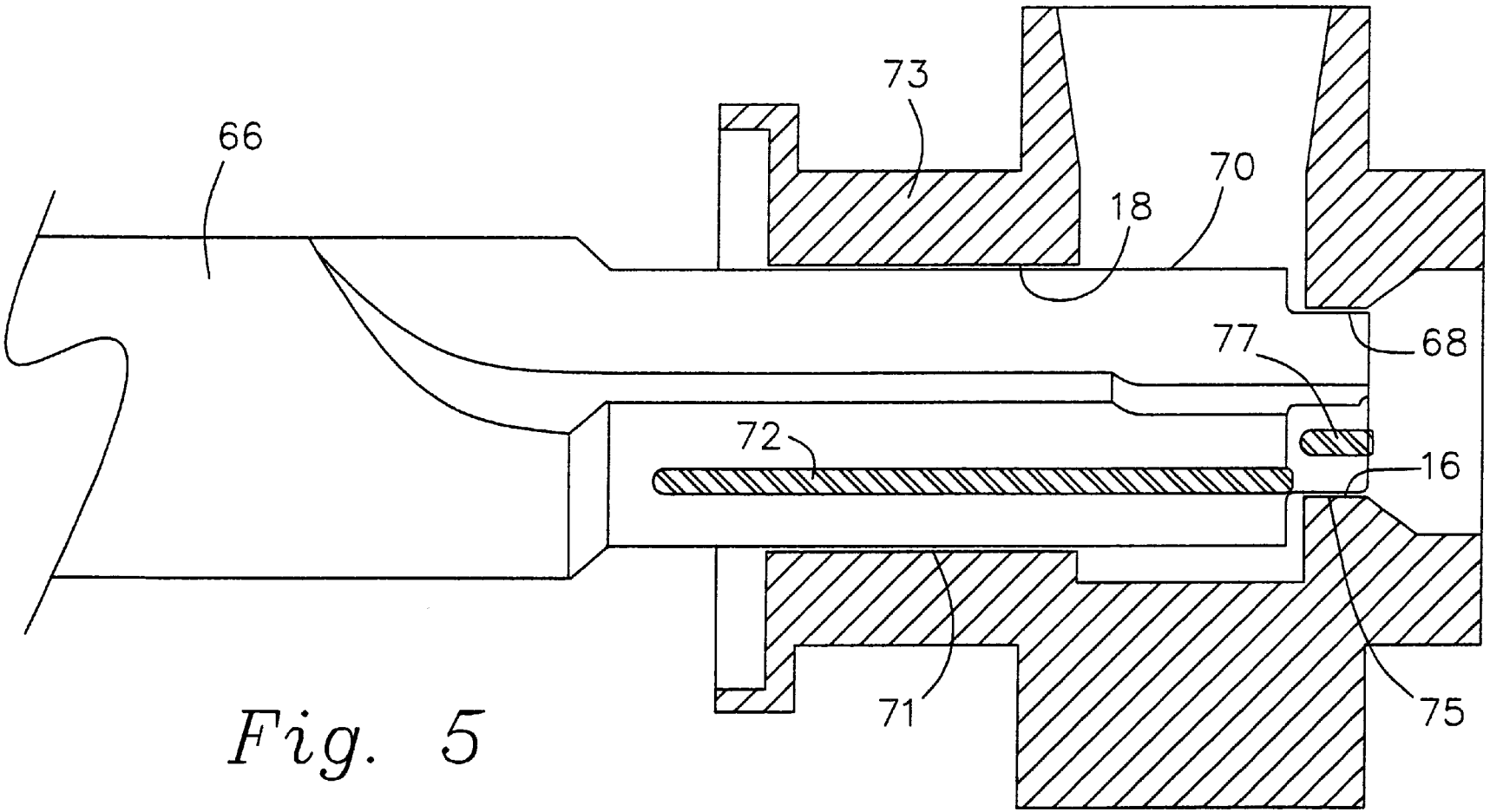
FIG. 5 is a schematic cross-section of a gun reamer finishing the central chamber of the housing.

Various means could be used in the broadest sense, but in the preferred embodiment, the outlet port 16 and piston port 18 are finished using a finishing reamer 66. The finishing reamer 66 may take the form of a gun reamer (as illustrated in FIG. 5), having a small diameter cutting surface 68 for finishing the outlet port 16 and a large diameter cutting surface 70 for finishing the piston port 18. The small and large diameter cutting surfaces 68, 70 are arranged on the gun reamer 66 so that the small diameter cutting surface leads the large diameter cutting surface during the finishing operation. During the operation, the gun reamer 66 is driven axially through a first portion 71 of an unfinished housing 73 so that the large diameter cutting surface 70 first begins to finish the piston port 18. As the gun reamer 66 is driven axially further through a second portion 75 of the unfinished housing 73, the small diameter cutting surface 68 finishes the outlet port 16. It will be appreciated that the large diameter portion of the finishing reamer 66 centers the reamer inside the piston port 18 so that they outlet port 16 is formed substantially concentric with the piston port 18. In the most preferred embodiment, the finishing reamer 66 has inserts 72, 77 for reducing vibration and "chatter" during the process, so that the outlet port 16 and piston port 18 have a finish better than approximately 8$\mu$-in and are concentric within approximately 0.0001 inches. The gun reamer process is easily and accurately repeated, thereby providing a reliable method for forming the central chamber 21 in the housing 20. The precision with which the outlet port 16 and piston port 18 are formed more reliably ensures that a complete seal will be formed when the piston 24 is in the closed position.

According to certain embodiments, the central chamber 21 is roughed in, prior to finishing, using a roughing tool. The roughing tool may be similar to the finishing tool in that it is a gun reamer having large and small diameter portions. The roughing tool is not the final process for forming the chamber, and therefore inserts are not needed. By using a roughing tool, the central chamber 21 may be formed using a simple, two step process. First, the roughing tool is driven through the housing to obtain a rough central chamber having outlet and piston parts close to the desired dimensions. The finishing reamer 66 is then axially driven through the rough central chamber so that the outlet port and piston port are formed substantially concentric and with relatively high finishes as noted above.

To further ensure reliable internal seals, the materials used to form the piston 24 and housing 20 are matched. It is commonly known that different materials expand at different rates when temperature is increased. Accordingly, it will be appreciated that if the housing 20 and piston 24 are formed of different materials, the difference in coefficient of thermal expansion of those materials causes the members to expand at different rates. The expansion acts both radially, which may create a gap or cause interference between the critical portions of the housing 20 and piston 24, and axially, which may cause misalignment between the members. To address this concern, the present invention uses a piston 24 and housing 20 formed of the same material, thereby minimizing the effects of thermal expansion. In the preferred embodiment, the critical portions of the piston 24 and housing 20 are formed from aluminum, however other durable materials, such as stainless steel, may also be used.

Figure 3:
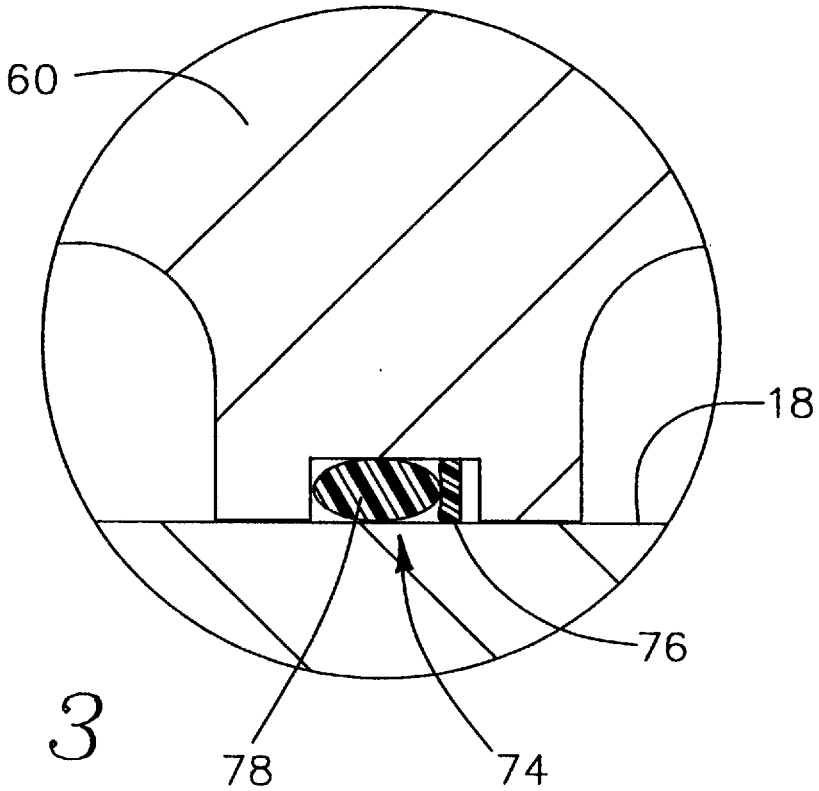
FIG. 3 is an enlarged view of Detail A of FIG. 2 illustrating the cross section of a piston gasket attached to the actuating piston.

The valve as described to this point is suitable for use with gaseous fire suppression materials. A further embodiment, described below, is particularly adapted for use with dry powder material. In this embodiment, the actuating piston 60 of the two-stage piston 24 carries a piston gasket 74 which prevents powder from disrupting the seal between the actuating piston 60 and piston port 18. The piston gasket 74 comprises a scraping member 76 and a sealing member 78. As illustrated in FIGS. 2 and 3, the scraping member 76 has a substantially rectangular cross-section and extends from the actuating piston 60 to engage the piston port 18. The sealing member 78 has a substantially round or oval cross-section like a conventional o-ring to form a seal between the actuating piston 60 and piston port 18. Accordingly, it will be appreciated that as the piston 24 moves from the open position to the closed position, the scraping member 76 clears powder from the piston port 18, thereby preventing powder from disturbing the seal between the actuating piston 60 and the piston port 18 formed by the sealing member 78.

The piston end 61 of the present invention is similarly adapted for repeated use with dry powder suppression material. As best illustrated in FIGS. 1 and 2, piston end 61 is removable from the remainder of the piston 24 with minimal disassembly of the valve 10. The piston end 61 has a threaded end which engages a neck 80 of the piston 24. The neck 80 has a pair of opposing flats 82 which may be gripped by a wrench inserted through the central connection 22. The piston end 61 has a socket 84 which is accessible through the discharge port 16 and accepts a tool (such as an allen wrench). With the neck firmly gripped, the piston end 61 may be unscrewed from the neck 80 using the tool inserted in the socket 84. The piston end 61 may then be dropped through the central connection 22, thoroughly cleaned, and reattached to the neck 80. Removal of the piston end, therefore, requires minimal disassembly or manipulation of the valve.

The piston end carries an outlet gasket 85 for sealing between the piston end 61 and outlet port 16. According to the embodiment illustrated in FIG. 2, the outlet gasket 85 is a conventional o-ring sized to fit over the piston end 61 and engage the outlet port 16. The o-ring may easily be removed and replaced when the piston end 61 is detached. After the piston end is cleaned and the gasket replaced, the piston end 61 may be reattached to the neck 80 for subsequent use.

Figure 4:
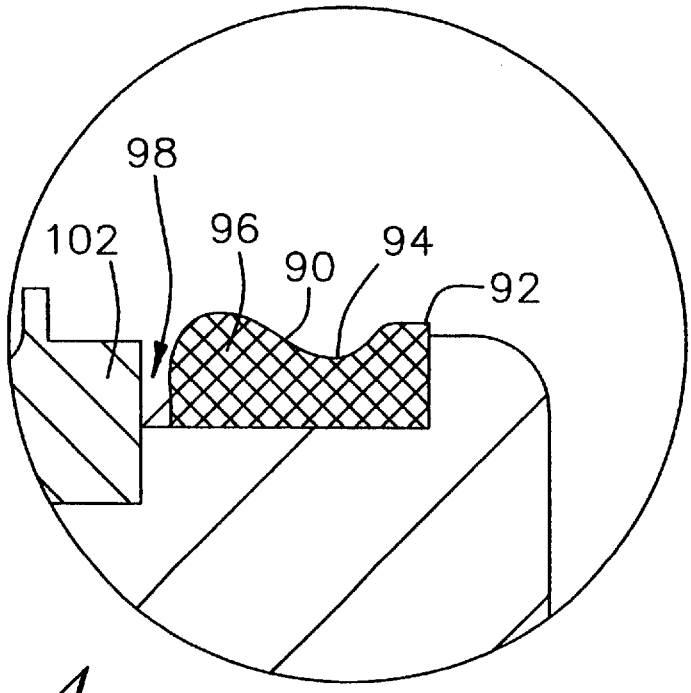
FIG. 4 is an enlarged view of Detail B of FIG. 1 showing the cross section of the permanent outlet gasket attached to the piston end.

In the most preferred embodiment, the outlet gasket is a specially formed gasket 90 for permanent bonding to the piston end 61 (FIG. 4). The specially formed gasket 90 has a complex, R-shaped cross section generally comprising a scraping portion 92 connected by a web 94 to a sealing portion 96. The scraping portion 92 is disposed near a face 63 of the piston end 61 and has a substantially rectangular cross-section to form a leading edge as the piston 24 moves from the open to the closed position. The scraping portion 92 therefore scrapes particles of powder from the outlet port 16 as the piston end 61 reengages the outlet port. The sealing portion 96 has a substantially round or oval cross-section to provide structure similar to an o-ring for sealing the piston end 61 with the outlet port 16. The scraping portion 92 of the specially formed gasket 90 prevents powder particles from reaching the sealing portion 96, thereby more reliably sealing between the piston end 61 and outlet port 16. The specially formed gasket 90 may be permanently bonded to the piston end 61 to prevent accumulation of dry powder between the gasket and the piston end. Furthermore, when the gasket 90 is permanently bonded to the piston end 61, a potential leak path between the piston end and the gasket is eliminated.

The specially formed gasket 90 is also pressure energized to more reliably seal between the piston end 61 and outlet port 16. As best shown in FIG. 4, a gap 98 exists between a trailing edge of the sealing portion 96 and a flange 102 of the piston end 61. The gap 98 allows pressure to act on the projected surface of the sealing portion 96 to thereby energize the seal formed between the piston end 61 and outlet port 16, in a manner similar to that of an o-ring. The gap 98 also allows the sealing portion 96 to be simply and easily cleaned with pressurized air for subsequent reuse.

In short, the scraping portion 92 sufficiently scrapes the outlet port 16 free of powder material to minimize infiltration of powder at the sealing portion 96. As a result, the permanent specially formed gasket 90 need only be cleaned, rather than replaced, between uses. Accordingly, the permanent outlet gasket 90 may be directly bonded to the piston end 61, thereby eliminating a potential leak path between the piston end 61 and the outlet gasket 90.

In the most preferred embodiment, the piston and outlet gaskets 74, 85 have a relatively high seal compression against the central chamber 21. A coat of lubricant, such as a tungsten disulphide known as DICRONITE DCS, is applied to the central chamber 21 to mitigate the resulting static and dynamic friction created by the higher seal compression.

When constructed in accordance with any of the embodiments described above, the valve has been found to have a leakage rate of less than $1\times10^{-5}$ cc/sec over a temperature range of −60° F. to +160° F. when used with nitrogen gas.

From the foregoing, it will be apparent that the present invention brings to the art a new and improved fire suppression valve having a low profile. The vertical height of the valve is minimized, thereby allowing a larger cannister, and consequently increased amount of suppression material, to be used with the valve in a limited envelope of space. The valve has a transversely mounted two-stage piston which includes an actuating piston for operating the two-stage piston between closed and open positions. A preferred embodiment of the valve is particularly suited for use with fire suppression materials having low molecular weight. A central chamber of the valve housing has sealing areas formed by a gun reaming process which ensures precision and concentricity. Furthermore, the materials used for the housing and piston are matched. Accordingly, the internal chamber of the valve is more reliably sealed. Another embodiment of the valve is particularly adapted for use with dry powder suppression materials. The actuating piston carries a piston gasket having a scraping member which prevents powder from reaching a sealing member of the gasket. A piston end of the two-stage piston, opposite the actuating piston, is similarly adapted for dry powder suppression material. The piston end is removable to allow easy cleaning. When the piston end carries a conventional o-ring, the o-ring may easily be removed and replaced when the piston end is detached. In the most preferred embodiment, the piston end carries a specially formed gasket having scraping and sealing portions. Similar to the piston gasket, the scraping portion clears powder from the outlet port to ensure a more reliable seal at the sealing portion.

The present invention further brings to the art a method of forming a central chamber of a fire suppression valve. The method comprises using a gun reamer to finish the chamber. The gun reamer forms a piston port and an outlet port that are substantially concentric and have relatively high finishes. The method is easily reproducible and therefore provides a simple way to form a plurality of valves having central chambers formed to close tolerances.

What is claimed is:

1. A fire suppression valve for attachment to a cannister of pressurized fire suppression material, the valve comprising:

a housing having a central connection for attachment to the cannister, the central connection communicating with a central chamber having a relatively smaller outlet port on one side and diametrically opposite thereto a concentric relatively larger piston port;

a two-stage piston in the central chamber and held in a closed position by a triggering mechanism, the two-stage piston being formed so that, in the closed position, a piston end is disposed in and seals with the outlet port and an actuating piston seals the piston port so that suppression material in the cannister is substantially prevented from escaping;

the pressurized fire suppression material serving to bias the two-stage piston toward an open position such that, when the trigger is actuated, the actuating piston carries the two-stage piston to the open position, removing the piston end from the outlet port and releasing the suppression material.

2. The valve of claim 1 in which the piston end is separately removable from the actuating piston.

3. The valve of claim 2 in which the piston end carries a removable o-ring.

4. The valve of claim 2 in which the piston end carries an outlet gasket having a scraping portion and a sealing portion.

5. The valve of claim 4 in which the outlet gasket is permanently bonded to the piston end.

6. The valve of claim 4 in which the scraping portion has a rectangular cross-section and is connected by a web to the sealing portion.

7. The valve of claim 4 in which the actuating piston carries a piston gasket having a scraping portion and a sealing portion.

8. The valve of claim 4 further comprising a gap between the sealing portion of the outlet gasket and a side gasket seat wall.

9. The valve of claim 1 in which the outlet port and piston port are concentric within approximately 0.0001 inches.

10. The valve of claim 1 in which the outlet port and piston port have surface finishes of less than 8$\mu$-inches.

11. The valve of claim 1 in which the piston port and outlet port of the housing, and the piston end and actuating end of the two-stage piston are formed from a same metallic material.

12. The valve of claim 11 in which the metallic material is aluminum.

13. A fire suppression valve for attachment to a cannister of pressurized fire suppression material, the valve comprising:

a housing having a central connection for attachment to the cannister, the central connection communicating with a central chamber having a relatively smaller outlet port on one side, and diametrically opposite thereto a concentric relatively larger piston port, the central connection and cannister oriented along a first axis, and the central chamber oriented along a second axis, the second axis disposed at an angle with respect to the first axis;

a two-stage piston moveable inside the central chamber and held in a closed position by a trigger mechanism, the two-stage piston having a piston end associated with the outlet port and an actuating piston sealing with the piston port, the piston operable between a closed position, in which the piston end is disposed in and seals the outlet port to substantially prevent suppression material from escaping, and an open position, in which the piston end is spaced from the outlet port to allow discharge of the suppression material;

wherein, with the two-stage piston in the closed position, the pressurized suppression material serves to bias the two-stage piston toward the open position such that, when the trigger mechanism is actuated, the actuating piston carries the two-stage piston to the open position.

14. The valve of claim 13 in which the second axis is oriented at substantially a right angle with respect to the first axis.

15. The valve of claim 14 in which the piston end is separately removable from the actuating piston.

* * * * *